US005692740A

United States Patent [19]

Holtje

[11] Patent Number: 5,692,740

[45] Date of Patent: Dec. 2, 1997

[54] DISK TYPE INVERTER-STACKER WITH IMPROVED SHEET CONTROL WITH AUTOMATICALLY REPOSITIONABLE FINGERS

[75] Inventor: Bruce E. Holtje, Berkshire, N.Y.

[73] Assignee: Xerox Corporation, Stamford, Conn.

[21] Appl. No.: 735,930

[22] Filed: Oct. 23, 1996

[51] Int. Cl.[6] ..... B65H 39/02; B65H 29/00

[52] U.S. Cl. ..... 270/58.01; 271/186; 271/187; 271/315

[58] Field of Search ..... 270/58.01, 58.07, 270/58.11, 52.01; 271/186, 187, 314, 315

[56] References Cited

U.S. PATENT DOCUMENTS

| | | | |
|---|---|---|---|
| 5,058,880 | 10/1991 | McGraw et al. | 271/315 |
| 5,065,997 | 11/1991 | Butts et al. | 271/315 X |
| 5,163,672 | 11/1992 | Mennie | 271/315 X |
| 5,261,655 | 11/1993 | Keller et al. | 271/315 X |
| 5,409,201 | 4/1995 | Kramer | 270/53 |
| 5,473,420 | 12/1995 | Rizzoo et al. | 270/58.08 X |
| 5,476,256 | 12/1995 | Fortuna et al. | 271/315 X |

FOREIGN PATENT DOCUMENTS

| | | |
|---|---|---|
| 2-31281 | 2/1990 | Japan . |
| 2-40754 | 3/1990 | Japan . |

*Primary Examiner*—Hoang Nguyen

[57] ABSTRACT

The disclosed rotatable disks type sheet inverting, registration and stacking system has finger units, with sheet carrying slots, which are mounted to the disk units for variable radial movement. These finger units automatically adjust their radius to release sheets from their respective slots closely adjacent to the top of the output stack of sheets at their registration position to automatically compensate for variations in the height of said stack of sheets, preferably by limited force engagement of the ends of the fingers with the top of the stack. Preferably the finger units are radially pivotally outwardly lightly spring loaded to provide a transporting and inverting position for the sheets in the sheet slots which is at a substantially greater radius than the reduced radius thereof in releasing the sheets at the stacking registration position. A vertically movable sheet hold-down bail system is automatically actuated in coordination with the release of the sheet to only engage the sheet when it is very closely adjacent to the top of the stack.

6 Claims, 4 Drawing Sheets

DISK TYPE INVERTER-STACKER WITH IMPROVED SHEET CONTROL WITH AUTOMATICALLY REPOSITIONABLE FINGERS

Disclosed in the embodiments herein is an improved disk type inverter-stacker with improved control of the sheets being inverted and stacked, having one or more variable radius repositionable fingers defining the sheet carrying slots of the disk units and providing a controlled release of the sheets in the stacking area closely adjacent to the top sheet of the stack of sheets, by automatically adjusting the finger radius to the actual stack height.

This disclosed system can also prevent inadvertent stacked sheet skewing or damage, or damage to the fingers, by variations in the stack height in the output area, i.e., a stack height which might otherwise be too high relative to the radius of the rotating disk unit. The disclosed fingers can automatically retract in their outer radius to not exceed the stack height as the fingers are rotated past the stack.

An additional disclosed advantage in these embodiments is provided by the allowable increase in the initial sheet transporting radius by outward movement of the fingers during that portion of their rotation, which can be greater than the radius at the sheet release area, so as to provide with such larger radius a bearer control over the inversion path for large flimsy sheets, thereby helping to push the trailing ends of such sheets further out over the stack as they are being invaded to reduce the tendency for premature sheet buckling or collapse and miss-stacking.

As further disclosed in the embodiments herein, this system has synergistic cooperative advantages when combined with a bail or normal force stacking assistance system. By automatically releasing the incoming sheet very closely to the top of the stack, e.g., less than approximately 3 mm above the stack, irrespective of stack height variations, in coordination with engagement of the sheet by an active bail system, sheet deformation from the bail engagement of the sheet between or outside of the fingers can be greatly reduced. By the bail or bails pressing down on each sheet as that sheet is being released only after that sheet is already almost resting on top of the stack, the bail cannot undesirably buckle the sheet to a large extent, even with bails laterally offset from the fingers carrying the sheets.

In contrast to prior systems, here in the disclosed embodiments the bails desirably do not engage the incoming sheet while that sheet is still "airborne" or "floating" relatively unconstrained and liable to undesired misregistration movement until a substantial air cushion under that sheet is overcome and the sheet is finally brought down into contact with the preceding sheet on top of the stack. Of course, releasing the sheet without a bail engagement in that "airborne" or "floating" situation is even more likely to result in misregistration or miss-stacking, and both situations can be avoided here.

Further discussing disclosed features of the embodiments, variations in stack height of 6 mm or greater can be automatically accommodated by the embodiment systems without requiring a corresponding increase in the incoming next sheet release point or drop distance above the stack. This allows much less critical stack height control, feedback, and stacking tray elevator movement for the stack level repositioning. Also, there is improved accommodation for sheet edge curl in the stack affecting or causing uneven stack height. Furthermore, positive stack settling assistance by the disk fingers themselves can be provided (in addition to, or as an alternative to, the use of bails) to apply a normal force to the top of the stack during registration and stacking of the incoming next sheet.

As noted above, and as well known in the prior art, releasing a sheet in a position or plane spaced above the top of a stack allows the sheet to temporarily "float" on an air cushion between the released sheet and the top sheet of the stack, and that can undesirably result in an uncontrolled movement of the sheet out of the desired stacking registration position. Once the sheet is released from the controlling slots or nips of the fingers of a disk stacker, typically by being stripped therefrom by a registration wall or fingers, the sheet is no longer under the control of the disk system. A free-floating entering sheet which is released above the top of the stack can even rebound or bounce away from the registration wall or registration fingers, since there is then no pinch or hold on the paper, unless a non-slip bail normal force is or has been applied to the top of the incoming sheet. However, such bails themselves, depending on their mass, can bounce and briefly lose engagement with their underlying sheet. Also, if the bail first engages the sheet while the sheet is still up in the air, this considerably reduces the engagement force and thus the holding force on the sheet by the bail.

Thus, by greatly reducing the normal release point of the sheet above the stack, as disclosed herein, the time for the bail to press the sheet down with sufficient normal force for non-slip engagement is also reduced. Also reduced are chances for bouncing of the bail relative to the sheet before the bail grips the sheet with sufficient vertical normal force and friction to prevent lateral sheet movement. The effective bail normal force here is increased and/or the bail mass can be reduced to decrease bouncing.

It is noted that incoming sheets bouncing or rebounding away from the registration wall or fingers while floating can be partially compensated by sloping the output tray downward toward the registration position. However, that compensation is not active, only gravitationally passive, is less effective for larger sheets, highly variable due to sheet to sheet friction, and is not considered to occur rapidly enough for rapid, high rate, printing systems.

However, heretofore, providing a system in which the fingers release the incoming sheet closer to the top of the stack could result in undesirable rubbing of the outer surface of the finger ends with a pressure which would be undesirable and probably uneven between fingers due to inevitable differences in stack height or alignments, which could result in a skewing force or even sheet creasing or abrading of the upper sheets of the stack, or stalling of the disks. Reducing the diameter of prior art disk stackers to avoid the latter problems would undesirably raise their sheet release point, and reduce the control of the trail edge of the paper during the flip-over and dropping of the sheet to the stack, particularly for larger and/or flimsy sheets of paper.

An additional disclosed feature in the embodiments herein is an improved gripping of the sheet within the slot defined by the disk finger to better hold the sheet within the outer diameter of the slot, and be nearer to the release end of the slot, at its maximum radius. This improved retention of the sheet within the disk (as the sheet is inverted, before it is released) is, however, here fully compatible with both subsequent sheet release onto the stack and optional lateral tamping for side registration of the same sheet during that movement. Such lateral sheet tamping systems, e.g., elements 40 et al in the below-cited U.S. Pat. No. 5,409,201, are fully described therein and elsewhere and need not be redescribed herein. The disclosed system is desirably compatible with such lateral edge tamping, or the like.

Another disclosed feature in the embodiments hereinbelow is to avoid changes in the nip force of the sheet entrance springs for the nip slot by attaching the finger spring to the finger itself rather than to the disk carrying the finger. Thus, the movement of the finger relative to the disk does not change the spring tension in the spring which retains the sheets nipped in the finger slots in these embodiments.

Another disclosed feature in the disclosed embodiments is that the movable sheet transporting finger is preferably held outwardly away from the disk by another, very limited force, spring, with sufficient spring force to hold the finger out into the sheet receiving position, even for heavy sheets entering the finger, yet providing only a very low or minimal contact force between the finger and the top of the stack in the release area even if the finger is being substantially pushed in to a substantially reduced radius, against that spring force, by contact between the end of the finger and a high or full stack in the stacking area.

The disclosed embodiments are also fully compatible or incorporatable with on-line or subsequent stapling or other finishing of sets of sheets stacked for compiling with the above and other advantages. For example, the variable position stapling and registration system of copending U.S. application Ser. No. 08/689,616, filed Aug. 12, 1996 by Joseph J. Ferrara, et al entitled "Variable Sheet Sets Stapling and Registration Positions System" (D/96336), or set finishers of other patents cited below, such as U.S. Pat. No. 5,409,201, etc. Various other additional features may be incorporated with the present embodiments.

By way of more general background, in reproduction apparatus such as xerographic and other copiers and printers or multifunction machines, it is increasingly important to provide faster yet more reliable and more automatic handling of the physical image bearing sheets. It is desirable to reliably feed and accurately register sheets of a variety and/or mixture of sizes, types, weights, materials, humidity, and other conditions or susceptibility to damage. In particular, it is desirable to minimize sheet misfeeding, skewing, jamming, wear or damage. The sheets which may be handled in or outputted from reproduction apparatus may even have curls, wrinkles, tears, "dog-ears", punched holes, adhesive, slippery areas, or other irregularities. Sheets can vary considerably even if they are all of the same "standard" size, (e.g. letter size, legal size, A-4, B-4, etc.). They may have come from different paper batches or have variably changed size with different age or humidity conditions, different imaging, fusing, etc. Sheet misregistration or misfeeding can also adversely affect further feeding, ejection, stacking and/or finishing.

Further by way of background as to the disclosed embodiments, the disclosed embodiments can be considered in several respects as improvements over the integral disk type inverter-stacker and stapler system with a bail system of Xerox Corp. U.S. Pat. No. 5,409,201 issued Apr. 25, 1995 to William E. Kramer, but sharing many of the features and advantages of the latter as well. Accordingly, these and other references cited therein or herein may be referred to for further details which need not be redescribed herein.

Other examples of disk stacker systems with registration assistance devices include Xerox Corp. U.S. Pat. No. 5,058,880 issued Oct. 22, 1991 to T. C. McGraw, et al; and U.S. Pat. No. 5,114,135 issued May 19, 1992 to D. D. Evangelista, et al.

Another example of a disk stacker patent, with a discussion of difficulties in stacking flimsy sheets, especially the trailing ends thereof, is Xerox Corp. U.S. Pat. No. 5,261,655 issued Nov. 16, 1993 to Paul D. Keller, et al. That system, however, calls for corrugation of the trailing areas of the sheets while they are in the disk with intermittently interdigitated rollers and a stacking assistance belt.

A specific feature of the specific embodiments disclosed herein is to provide a disk type sheet inverting and stacking system with a stacking registration position and rotatable disk units with sheet transporting slots, in which printed sheets outputted by a reproduction system are sequentially fed into said sheet transporting slots in said disk units to be transported therein and inverted by rotation of said disk units and then released from said sheet slots of said disk units at said stacking registration position stacked on top of the stack of prior such sheets; the improvement comprising finger units mounted to said disk units for radial movement relative to said disk units, said radially movable finger units providing said sheet slots thereon so that said finger units provide variable radius and variable position said sheet slots with radial movement of said pivotal finger units, said finger units automatically adjusting their radius to release sheets from their respective said sheet slots closely adjacent to said top of said stack of sheets at said stacking registration position to automatically compensate for variations in the height of said stack of sheets at said stacking registration position.

Further specific features disclosed herein, individually or in combination, include those wherein said finger units automatically reduce their radius by engagement with the top of said stack to release sheets from their respective said sheet slots closely adjacent to said top of said stack of sheets at said stacking registration position; and/or wherein said finger units are independently pivotally mounted to said disk units; and/or wherein said finger units are radially outwardly spring loaded to provide said transporting and inverting position for the sheets transported in said sheet slots at a substantially greater radius than said reduced radius thereof in releasing said sheets at said stacking registration position; and/or further including a vertically movable sheet hold-down bail system automatically actuated in coordination with said release of said sheets from said sheet slots at said stacking registration position to engage said sheets with said bail system with said sheets closely adjacent to the top of said stack of sheets; and/or wherein said finger units automatically adjust their radius to release sheets from their respective said sheet slots less than 3 mm from said top of said stack of sheets at said stacking registration position.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art.

In the description herein the term "sheet" refers to a usually flimsy physical sheet of paper, plastic, or other suitable physical substrate for images, whether precut sheet or initially web fed. A "copy sheet" may be abbreviated as a "copy", or called a "hard copy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described herein.

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

Figure 1:
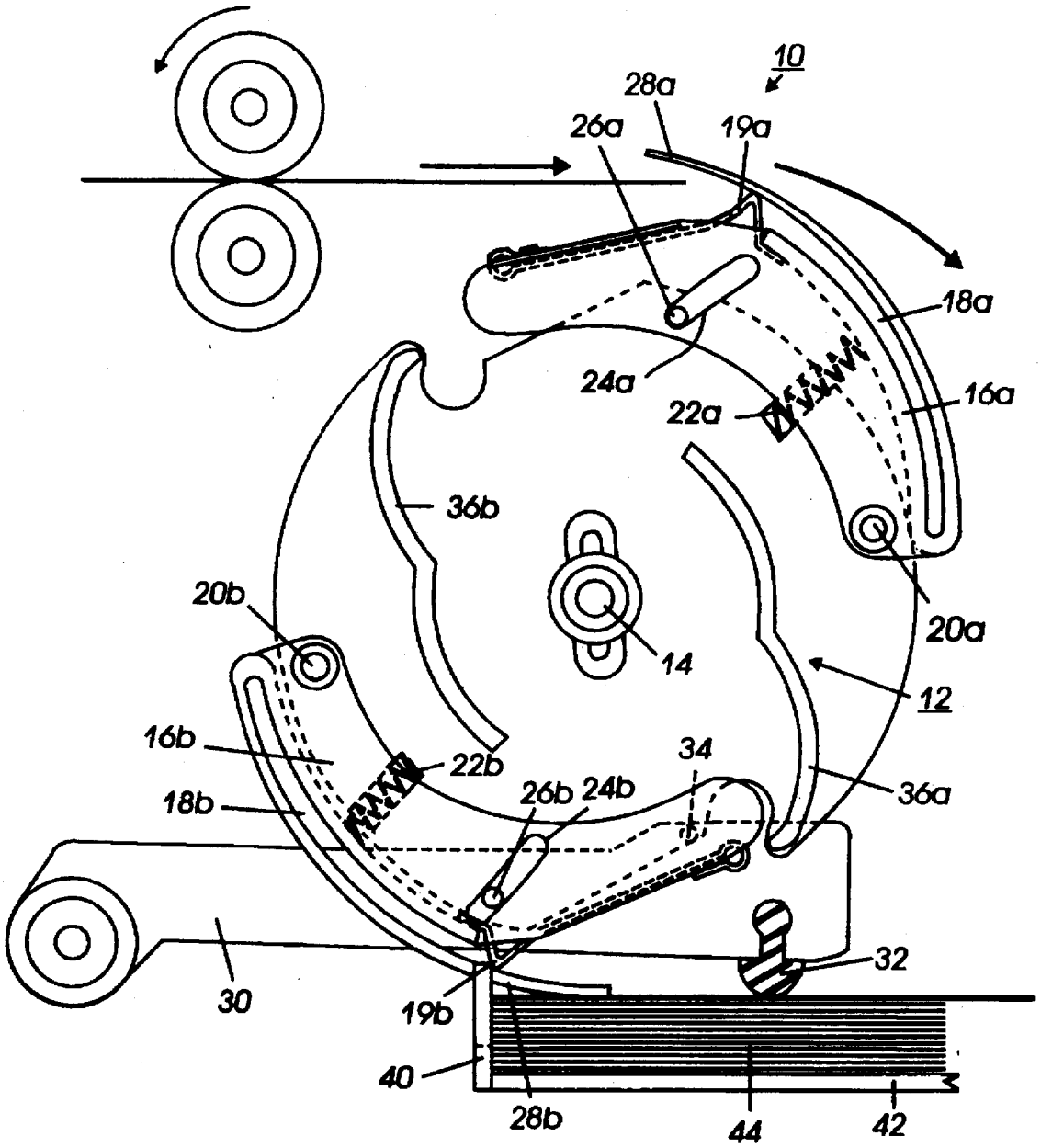
FIG. 1 is a front plan view of one exemplary embodiment of the disk units of an exemplary disk type output inverter-stacker system in accordance with the present disclosure.
Figure 3:
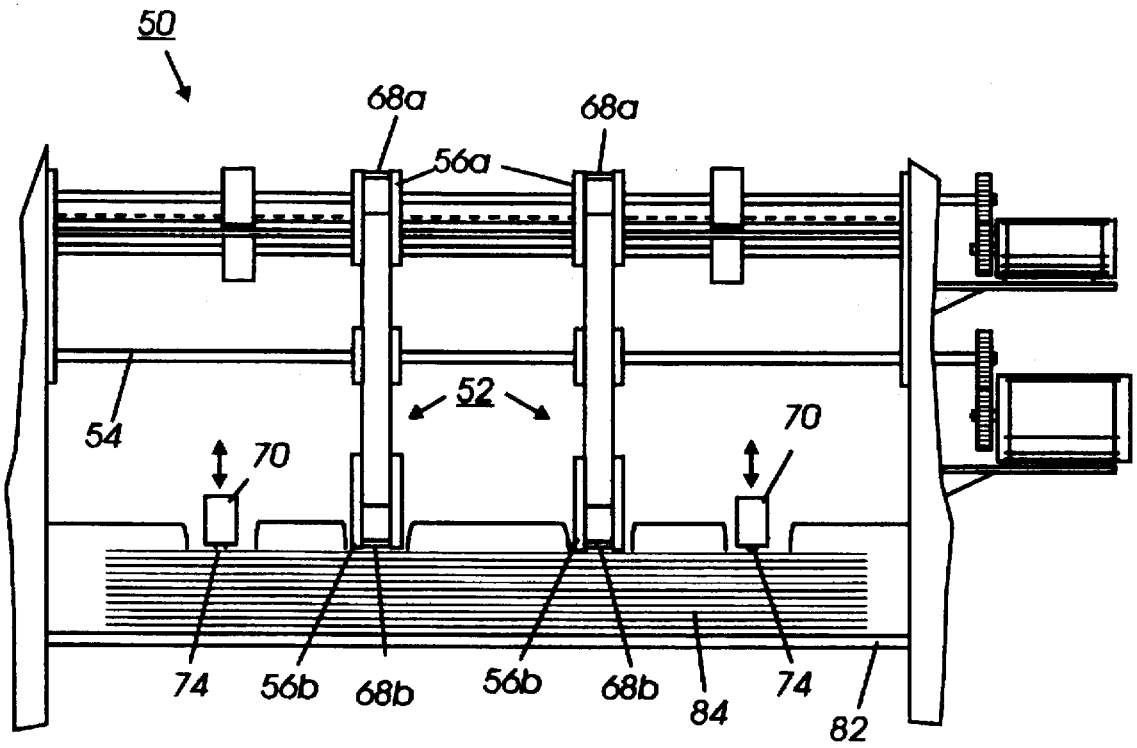
FIG. 3 is a partially schematic side or end view of the embodiment of FIG. 2, somewhat simplified by removing drawings of certain components not relevant to the present invention.
Figure 4:
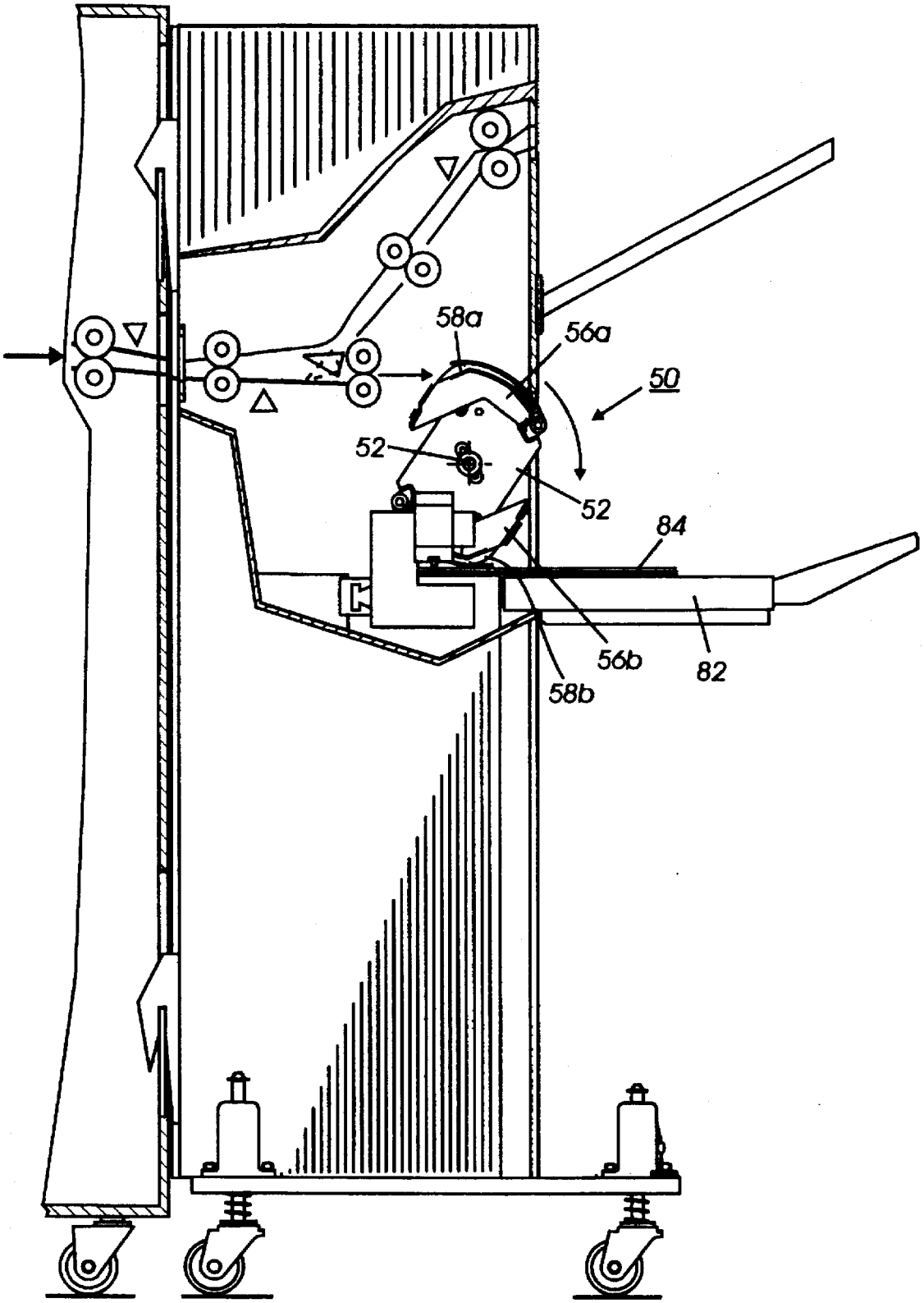
FIG. 4 shows the embodiment of FIG. 2 in an exemplary output stacking and finishing module mounted to the output end of an exemplary printer.

Referring first to the FIG. 1 embodiment first, there is shown from the front (therefore from the side of the paper path or process direction) an output inverter-stacker system comprising a plurality of disk units 12, of which the outboard one is visible in this view. A shaft 14 mounts and rotates these disk units 12 to invert and stack the sequential sheet output of the copier or printer for which the system 10 is an integral or modular output accessory, as illustrated in FIG. 4. Here, each of the disk units 12 has two pivotal finger units 16*a*, 16*b* respectively independently oppositely mounted on each side of the disk unit 12, to be described herein in more detail. However, it is also possible to have a disk unit with only one such finger unit. The following description with regard to FIG. 1 is also to a large extent also applicable to the embodiment of FIGS. 2–4.

Each of the finger units 16*a*, 16*b* here defines sheet slots 18*a*, 18*b* into which the incoming sheets are fed by the illustrated input roller nip in the unit 10 itself or in the output of the associated reproduction apparatus, which can be of almost any known type and therefore need not be described herein. The disk units 12 may be either stationary or moving when an incoming sheet is fed into the then uppermost sheet slot at that particular rotational position of the disk units 12. Here, that is the sheet slot 18*a*. As the sheets are fed into the sheet slots 18*a* or 18*b*, depending upon which finger unit 16*a* or 16*b* is uppermost at that point, the sheet is engaged by, and is fed past, a sheet entrance spring 19*a* or 19*b*. These springs 19*a*, 19*b* here are mounted on the pivotal finger units 16*a* and 16*b* respectively, rather than on the disk units 12 themselves, so as to maintain a constant spring force engaging the entering sheet irrespective of the finger position. This spring 19*a* or 19*b* is preferably a highly elongated spring, cantilevered mounted at the end opposite from its sheet engagement position, and in position to guide the sheet to the outermost side of the sheet slot 18*a* or 18*b*. The sheet is not obstructed from entering the sheet slots 18*a* or 18*b* by the springs, and is preferably fed into the slot until the lead edge of the sheet engages the end of the slot, as described in above-referenced patents. The springs 19*a* or 19*b*, however, maintain a constant outward pressure against the sheet to hold the sheet outwardly as the disks rotate and also to provide a positive nip force engaging the sheet in the slots.

Each of the pivotal finger units 16*a* and 16*b* is mounted at its downstream end by a pivotal mounting axis 20*a* or 20*b* to the disk unit 12, unlike prior disk units. These fingers 16*a* and 16*b*, and thus their slots 18*a* or 18*b*, are normally held out to their maximum radius from the central shaft 14 by finger opening springs 22*a* and 22*b*, which are offset at one side of the finger so as not to interfere with sheet movement and are loaded between the finger and the disk unit to hold their respective finger outwardly by only a light spring force, so that the finger can be easily pivotally moved inwardly with low force toward the disk unit to reduce the overall radius, as will be described. The maximum outward or radial movement of the finger units, and therefore the loading position of the sheet slots 18*a*, 18*b*, is controlled here by finger opening limiter slots 24*a*, 24*b* in which a finger opening limiter pin 26*a*, 26*b* on the disk unit 12 slides and serves as a stop.

As the disk unit 12 rotates, carrying and inverting the next sheet to be stacked on stack 44 in the output tray 42, the larger radius downstream end of the finger unit 16*a* or 16*b*, in which the outer end of the sheet slot 18*a* or 18*b* is located, may conventionally pass through a cutout or notch in the registration wall 40, which, as described in the prior art, causes the registration wall or fingers to engage the lead edge of that sheet and stop its forward movement, so that the continued rotation of the disk units 12 strips the sheet out of the slots 18*a* or 18*b* with the lead edge of the sheet held against the registration wall 40.

Referring to the lower or stripping area in FIG. 1, it may also be seen that the finger end outer surface 28*b* has a substantially larger radius than the upstream end of the fingers, especially in its spring 22*b* loaded outward position, and thus the slot 18*b* also tapers outwardly. Thus, as the sheet is stripped out of the slot 18*b* as shown here, the sheet is also being held downwardly by the spring 19*b* holding the sheet outwardly within the slot 18*b*, and providing beam strength in the arcuately deflected sheet, as long as the sheet is still partially held in finger unit 16*b*.

Somewhat prior to, and/or at the subsequent point in the rotation of disk unit 12 at which the lead edge area of the sheet is actually fully released out from the control of the sheet slot 18*a* or 18*b*, the outer end surface 28*a* or 28*b* of the sheet unloading finger here will be is directly engaging the top of the stack 44. Thus, prior to and during sheet unloading or release, the sheet is effectively separated from the top of the stack by only the very thin thickness of the outer wall of the finger outer end surface 28a, 28b. This finger tip can be as thin as 1 or 2 mm.

This direct engagement of the finger tip outer end surface 28a or 28b with the top of the output stack 44 adjacent the registration wall shortly before the end of sheet stripping from the finger slot is enabled by the pivotal mounting of the fingers. This allows each finger to automatically adjust to the actual stack height there during the stripping operation. It also allows the finger position to adjust to compensate for spacing differences between respective disk units 12, manufacturing tolerances, unevenness or movement errors in the stack elevator control of the output tray 42, and sheet curling, staples, or other unevenness in the sheet stack 44.

Thus, with this disclosed new system, the sheet, before it is released, is positively brought down into very close spacing, and/or even partially in direct contact, with the top of the stack 44 of preceding sheets, rather than, as discussed in the introduction as to some prior art devices, releasing the sheet in mid-air above the stack, or accidentally striking the top of the stack with a rigid disk and skewing the stack or damaging the sheets. These and other advantages previously described above in the introduction, and other advantages, will be apparent to those skilled in this art.

As taught in the above-cited U.S. Pat. No. 5,509,201, it is highly desirable to coordinate the release of the incoming sheet to be stacked with the lowering thereon of a bail such as 30, preferably with a high friction rubber or other bail tip 32 to engage with normal force and help hold the sheet in its proper registration position. Here in this FIG. 1 embodiment, the lifting of the bail 30 up out of the incoming sheet path and its subsequent release to drop onto that sheet at the appropriate time is controlled by a cam track 36a or 36b, which here is molded into the side of disk unit 12 in a position to engage and lift a bail pin 34 on the bail 30 by pin 34 riding up on top of the respective cam track to the end of that cam track as the disk unit rotates, whereupon the bail is released to drop onto the sheet being stripped.

Figure 2:
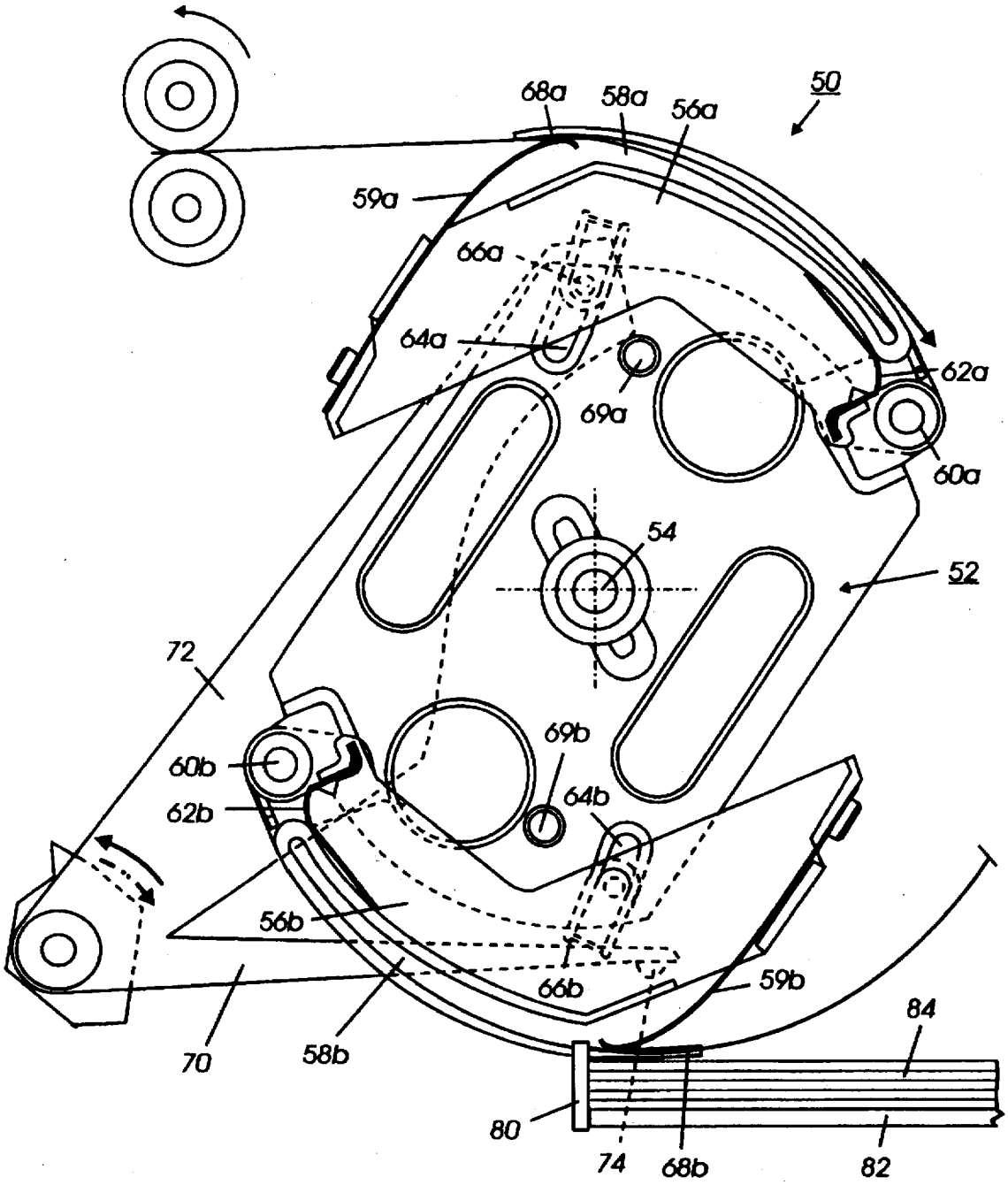
FIG. 2 is an improved embodiment in the same view as FIG. 1, with differences which will be described herein.

Turning now to the alternative embodiment of FIGS. 2 and 3, most of the above description applies thereto, with some differences which will be described hereinbelow. This output inverter-stacker system 50 has disk units 52 on a shaft 54 similarly operated, and with similar pivotal finger units 56a and 56b with similar integral sheet slots 58a and 58b, which finger units 56a and 56b are pivotally mounted on axes 60a and 60b respectively.

The finger opening springs 62a and 62b here differ in that they are leaf springs adjacent the axes 60a, 60b, but they provide the same function in outwardly urging the finger units 56a, 56b to pivot outwardly about the axes 60a, 60b to the maximum radial extension of their outer ends 68a, 68b allowed by the finger opening limits or stops provided by limiter slots 64a, 64b with limiter pins or fasteners 68a and 66b, snap fitted into the disk units 52.

The bails 70 in this system 50 are more like that shown and described in said U.S. Pat. No. 5,409,201. That is, the bail 70 is lifted by a bail actuating lever 72 connecting thereto, which lever 72 is engaged by a bail cam actuator pin 69a or 69b on the disk unit 52 as the disk unit rotates. The bail 70 and its bail tips 74 operate, however, in a similar manner to that described hereinabove, as well as that patent, but with significant synergistic cooperative advantages in the two systems shown here, as described above in the introduction. That is, in this embodiment of FIGS. 2 and 3, as in the FIG. 1 embodiment, the bail 70 cooperates with the pivotal finger units 56a, 56b to provide almost continuous control over the sheet with little or no "flotation" of the sheet, bounce back from the registration wall, or other undesirable sheet handling, due to the release of the sheet by the disk slots 58a, 58b and engagement of the sheet by the bail tips 72 both occurring very closely above the top of the stack 84 at all times, irrespective of the stack 84 height or the underlying tray 82 position, due to the automatic compensation of the sheet release point by the pivotal movement of the finger unit 56a, 56b, allowed by its pivotal mounting and rotation about its axis 60a, 60b, and the low resistance flexing of the finger opening springs 62a, 62b. Since the bail 70 comes down on the incoming sheet after that sheet is partially and/or almost in contact with the top of the stack, the bail tip 72 cannot significantly buckle or corrugate the sheet and almost immediately provides positive engagement and hold down of the sheet.

As noted above, all of the pivotal finger units disclosed here can greatly reduce their radius by their pivotal movement to accommodate substantial variations in the difference in radius between the central mounting shaft of the disk unit and the top of the stack. Yet, these same finger units can substantially pivot outwardly during the inversion movement of the sheet prior to the release area so as to provide better control over the sheet as it is being inverted, thereby pushing out the trailing areas of the sheet further out over the stack, and thus reducing the chances of the sheet trail area folding or buckling and mis-stacking. The sheet slot entrance level or position can desirably be at a constant fixed height position, defined by the above-described finger opening limiter slots and pins. Since there are two finger units per disk unit here, one sheet can be loaded into one finger and transported by its initially large radius position sheet slot while another sheet is being registered and stacked with its finger moved in to a much smaller radius position, varied automatically to compensate for the stacking position.

The finger units are described above as pivotally mounted, and that is presently preferred. However, it may be possible that with appropriate suitable plastic materials and moldings to provide sufficiently flexible finger cantilever mountings to the disk units so that they may be sufficiently radially movable inwardly from their outer ends with low force by contact with the top of the stack to provide the above—described features, are inherently lightly spring loaded outwardly, yet have sufficient stiffness internally to provide suitable sheet carrying slots.

While the embodiments disclosed herein are preferred, it will be appreciated from this teaching that various alternatives, modifications, variations or improvements therein may be made by those skilled in the art, which are intended to be encompassed by the following claims:

I claim:

1. In a disk type sheet inverting and stacking system with a stacking registration position and rotatable disk units with sheet transporting slots, in which printed sheets outputted by a reproduction system are sequentially fed into said sheet transporting slots in said disk units to be transported therein and inverted by rotation of said disk units and then released from said sheet slots of said disk units at said stacking registration position stacked on top of the stack of prior such sheets;

the improvement comprising finger units mounted to said disk units for radial movement relative to said disk units, said radially movable finger units providing said sheet slots thereon so that said finger units provide variable radius and variable position said sheet slots with radial movement of said pivotal finger units, said finger units automatically adjusting their radius to release sheets from their respective said sheet slots closely adjacent to said top of said stack of sheets at said stacking registration position to automatically compensate for variations in the height of said stack of sheets at said stacking registration position.

2. The disk type inverting and stacking system of claim 1, wherein said finger units automatically reduce their radius by engagement with the top of said stack to release sheets from their respective said sheet slots closely adjacent to said top of said stack of sheets at said stacking registration position.

3. The disk type inverting and stacking system of claim 1, wherein said finger units are independently pivotally mounted to said disk units.

4. The disk type inverting and stacking system of claim 2, wherein said finger units are radially outwardly spring loaded to provide said transporting and inverting position for the sheets transported in said sheet slots at a substantially greater radius than said reduced radius thereof in releasing said sheets at said stacking registration position.

5. The disk type inverting and stacking system of claim 1, further including a vertically movable sheet hold-down bail system automatically actuated in coordination with said release of said sheets from said sheet slots at said stacking registration position to engage said sheets with said bail system with said sheets closely adjacent to the top of said stack of sheets.

6. The disk type inverting and stacking system of claim 1, wherein said finger units automatically adjust their radius to release sheets from their respective said sheet slots less than 3 mm from said top of said stack of sheets at said stacking registration position.

* * * * *